US005961363A

United States Patent [19]

Spector

[11] Patent Number: 5,961,363

[45] Date of Patent: Oct. 5, 1999

[54] PACKAGE CONTAINING SHRUNKEN FIGURE

[76] Inventor: Donald Spector, 380 Moutain Rd., Union City, N.J. 07080

[21] Appl. No.: 09/129,991

[22] Filed: Aug. 6, 1998

Related U.S. Application Data

[63] Continuation-in-part of application No. 09/074,871, May 8, 1998, Pat. No. 5,897,418, and application No. 09/046,842, Mar. 24, 1998, Pat. No. 5,895,308.

[51] Int. Cl.[6] ..... A63H 5/00; A63H 3/00; A63H 3/36

[52] U.S. Cl. ..... 446/81; 446/73; 446/368; 446/385; 473/596

[58] Field of Search ..... 446/73, 75, 76, 446/81, 268, 368, 385, 435; 473/596, FOR 143

[56] References Cited

U.S. PATENT DOCUMENTS

| | | | |
|---|---|---|---|
| 2,760,302 | 8/1956 | Cheskin | 446/75 |
| 3,238,599 | 3/1966 | Bauman | 446/385 |
| 3,354,578 | 11/1967 | Ryan | 446/385 |
| 4,249,339 | 2/1981 | Crain et al. | 446/435 X |
| 4,454,253 | 6/1984 | Murphy et al. | 473/569 X |
| 4,815,607 | 3/1989 | Agapiou | 446/75 X |
| 4,881,915 | 11/1989 | Liaw | 446/368 X |
| 4,936,460 | 6/1990 | Meyer | 446/75 X |
| 5,405,148 | 4/1995 | Cianci | 446/368 X |
| 5,795,209 | 8/1998 | Moore | 446/73 |

FOREIGN PATENT DOCUMENTS

| | | | |
|---|---|---|---|
| 0206500 | 12/1986 | European Pat. Off. | 446/73 |

OTHER PUBLICATIONS

Instant Products, Inc., Jul. 1986.

*Primary Examiner*—D. Neal Muir
*Attorney, Agent, or Firm*—Michael Ebert

[57] ABSTRACT

A package housing a humanoid or animal-like figure, or other shaped object such as a miniature automobile, formed of porous, compressible material which when compressed to expel the air therefrom then assumes a shrunken state. The shrunken object is stuffed into the cavity of a small container having a form thematically related to the object stuffed therein. When the container is opened and the object released therefrom, the object inhales air to assume its normal full scale size and shape. Embedded in the object is a sound-producing electronic unit which when the object is agitated, then generates audible sounds appropriate to the object.

9 Claims, 2 Drawing Sheets

PACKAGE CONTAINING SHRUNKEN FIGURE

RELATED APPLICATIONS

This application is a continuation-in-part of the Spector application Ser. No. 09/074,871, filed May 8, 1998, now U.S. Pat. No. 5,897,418 entitled "TEST TUBE DOLL PACKAGE" and of the Spector application Ser. No. 09/046,842, filed Mar. 24, 1998 now U.S. Pat. No. 5,895,308 entitled "SOUND-PRODUCING SOFT TOY MISSILE" whose entire disclosures are incorporated herein by reference.

BACKGROUND OF THE INVENTION

1. Field of Invention

This invention relates generally to packages housing humanoid or animal-like figures or shaped objects, and more particularly to a package in which the object is first shrunken and then stuffed in a small container.

2. Status of Prior Art

In my above-identified copending patent application, "Test Tube Doll Package" there is disclosed a doll packaged in a test tube, the doll being constituted by a figure such as that of a baby, formed of compressible porous material whose plasticity is such that when the figure is compressed and thereafter released, it recovers its normal shape and size. When compressed, air is expelled therefrom and the figure is in a shrunken state so that it can be stuffed into the test tube which is then sealed by a stopper. To play with the doll, the stopper is removed and the shrunken figure is taken out of the test tube, the figure then inhaling air to recover its normal size and shape.

The present invention resides in a similar package except that the shrunken figure is stuffed into a small container whose form is thematically related to the figure which has a humanoid or animal-like form or that of a shaped object.

Underlying the present invention is the ancient myth of a genie or demon trapped in a bottle. When the finder of the bottle at the urging of the genie trapped therein, unstops the bottle and releases the genie so that it can assume its full scale ghost-like form, the genie then grants whatever it is that the finder wishes.

In my above-identified copending application, "Sound-Producing Soft Toy Missile", the missile is formed by a fabric casing stuffed with a compressible filler. Embedded in this filler is a miniature sound-producing electronic unit powered by a battery through an impact-sensitive switch. When the missile is let fly by a player and is then caught by a catcher, the resultant impact turns the switch on, causing the unit to generate audible sounds which, in effect, celebrate the catch.

In a package in accordance with the invention in which a shrunken figure formed of compressible material is stuffed into a small container whose form is thematically related to the figure, embedded in the figure is a sound-producing unit which when the object is agitated, then generates audible sounds appropriate to the object.

SUMMARY OF INVENTION

In view of the foregoing, the main object of this invention is to provide a package housing a humanoid or animal-like figure or other shaped object that in a shrunken state is stuffed into a small container whose form is thematically related to the object.

Thus if the figure included in the package resembles an alien from outer space, then the small container therefor resembles a space ship. But if the object is that of a dinosaur, then the small container therefor is a dinosaur egg. And if the object resembles an automobile, then the small container therefor resembles an auto tire.

More particularly, an object of the invention is to house in a package an object molded of flexible, open-cell foam plastic material which is highly compressible so that when the object is compressed to expel the air therefrom, it is then shrunken so that it can be stuffed into the small container.

Briefly stated, these objects are attained by a package housing a humanoid or animal-like figure or other shaped object molded of porous, compressible material which when compressed to expel the air therefrom then assumes a shrunken state. The shrunken object is stuffed into the cavity of a small container having a form which is thematically related to the object stuffed therein. When the container is opened and the object released therefrom, the object inhales air to assume its normal full scale size and shape.

Embedded in the object is a sound-producing unit which when the object is agitated, generates audible sounds appropriate to the object.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

First Embodiment

Figure 1:
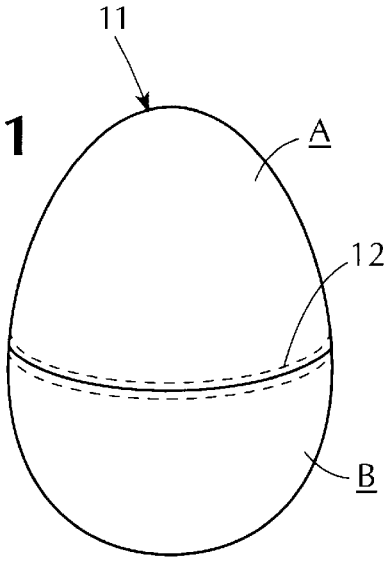
FIG. 1 is a perspective view of a package in accordance with the invention in which stuffed into an egg-shaped container is the figure of a dinosaur in a shrunken state.
Figure 2:
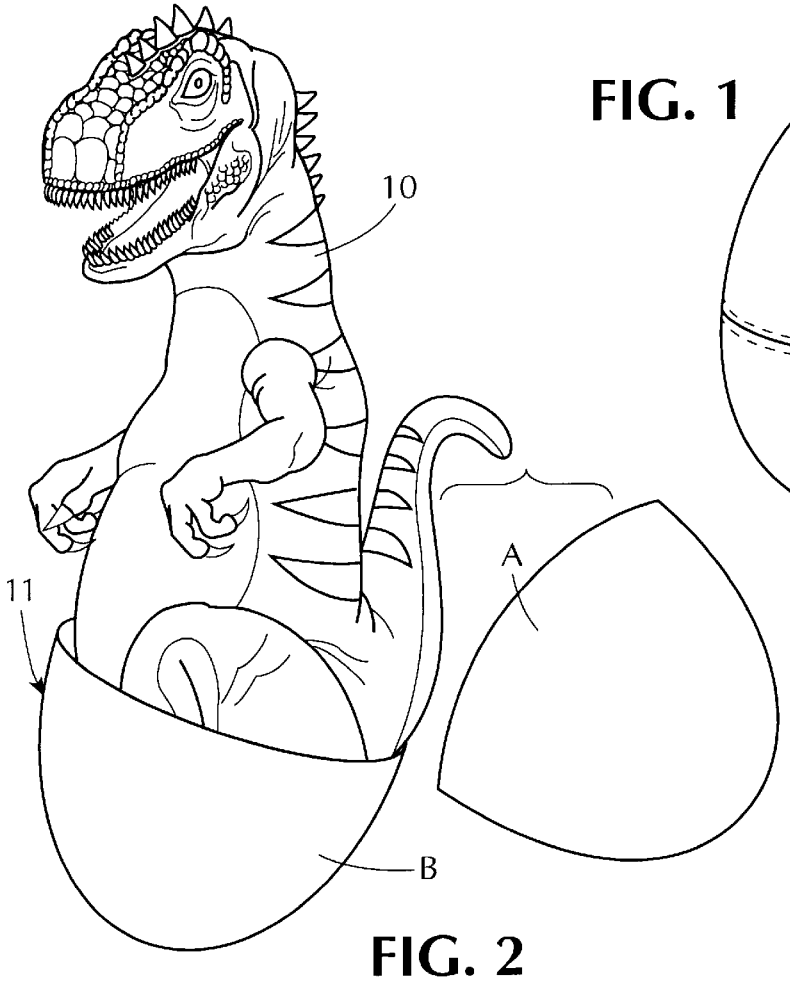
FIG. 2 shows the dinosaur emerging from the hatched egg.

Referring now to FIGS. 1 and 2, shown therein is a package in accordance with the invention formed by a FIG. 10 that is stuffed in a shrunken state into a egg-shaped container 11.

Egg-shaped container 11 which resembles a dinosaur egg is formed of separable half-sections A and B. These are held together by a band 12 of pressure-sensitive adhesive tape that encircles the abutting ends of the sections. Hence to open the egg, one has only to peel off the tape and separate the sections.

FIG. 10 which resembles a miniature dinosaur is molded of flexible, low-density, open-cell foam plastic material, such as polyurethene. This porous foam material is highly compressible yet its plasticity is such that regardless of the degree to which the figure is deformed under stress, the figure when released recovers its normal full size and shape. Thus if the figure normally has a height of 7 inches and a maximum girth of 5 inches, under compression, it can be shrunken to have a height of say 3 inches and a girth of 3 inches. Thus in a shrunken state, the dinosaur is almost ball-like in form and can be squeezed into a cavity in the container therefor.

The internal dimensions of the egg are close to those of the figure in the shrunken state, the length of the egg along its main axis being about three inches and the egg about its equator having a girth of about four inches.

When the foam-plastic figure is highly compressed to assume a shrunken state, air filling the open cells of the foam is expelled therefrom. The lower the density of the foam plastic material, the greater the degree to which it can be compressed.

When the egg is opened, as shown in FIG. 2, the shrunken dinosaur 10 stuffed therein springs to life, for the figure then inhales air to resume its normal, full scale size and shape.

Thus the egg-shaped container 11 is thematically related to the figure, for the container resembles the egg from which the dinosaur figure is hatched.

When the egg-shaped container 11 is formed of two complementary halves A and B, as shown in FIG. 1, these halves can be molded of flexible, synthetic-plastic material of high strength, such as polyethylene or PVC. However, if one wishes to simulate the birth of a dinosaur which is a reptile, the container may be formed of a fairly brittle synthetic plastic material, so that instead of separating the two halves of the egg to release the dinosaur figure, one cracks the egg open to do so.

Second Embodiment

In a package in accordance with the invention, there is no need for the small container to conform to the shape of the shrunken figure stuffed therein. All that is necessary is that the container be provided with an internal cavity large enough to accommodate the shrunken figure under compression which seeks to expand against the wall of the cavity. And the container must have a closure of some sort which when opened, then releases the pressurized figure in a shrunken state, so that it then springs to life.

Figure 3:
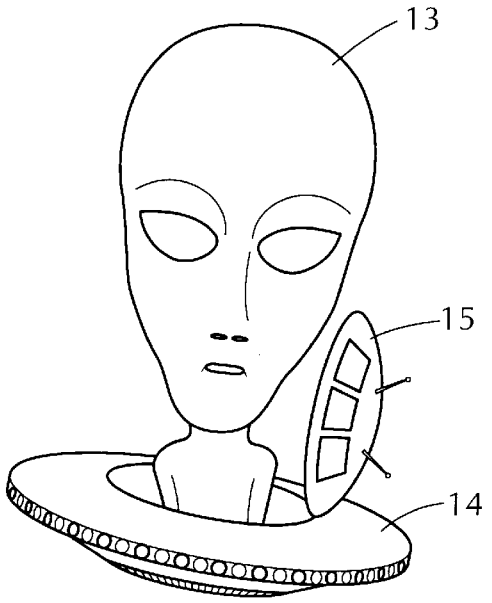
FIG. 3 shows a package in which a figure resembling an alien from outer space is stuffed in a shrunken state into a container resembling a space ship.

In the embodiment of a package in accordance with the invention shown in FIG. 3, the theme is outer space, for FIG. 13 is an extraterrestrial alien who in a shrunken state is housed in a small container 14 having a cavity therein just large enough to accommodate the figure.

Container 14 resembles a space ship or flying saucer from outer space, it being provided with a hinged lid 15 that resembles the flight deck of the ship. The space ship may be in other fanciful forms.

When lid 15 is closed, the shrunken figure of alien 13 is confined under pressure within the internal cavity of the space ship. Hence the space-ship container is thematically related to the extraterrestrial alien which it transports to earth.

Normally lid 15, when shut, is sealed. But when a child unseals the lid and opens it, the shrunken figure of the alien stuffed in the cavity of the container is released therefrom and inhales air to recover its full scale size and shape so that it can play with the earthling child who has released it.

Third Embodiment

A package in accordance with the invention is not limited to any particular form of humanoid or animal-like figure. However the form of the container must be thematically related to the form of the figure.

Figure 4:
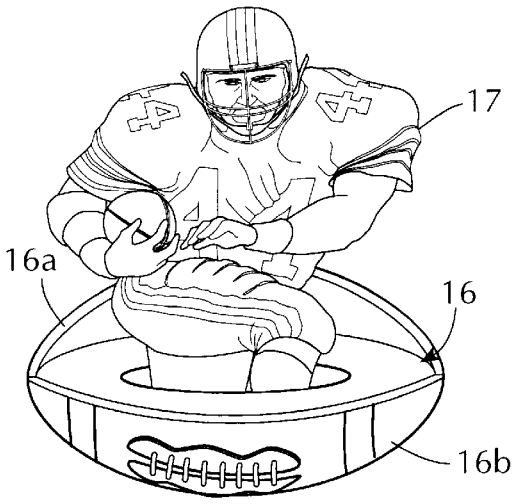
FIG. 4 shows a package in which the container resembles a football, and the figure emerging therefrom resembles a football player.

Thus in FIG. 4, the container 16 resembles a small football. Container 16 is made of two complementary half section 16*a* and 16*b* of flexible synthetic-plastic material which are similar to the two halves of the egg-shaped container in FIG. 1.

Stuffed in container 16 is a FIG. 17 that is molded of flexible open-cell foam plastic material to resemble a football player, the material being of low density and being highly compressible. FIG. 17 in a shrunken state is stuffed into the container 16 resembling a football. When this football is cracked open, the football player confined therein springs back into life.

Fourth Embodiment

In the embodiment shown in FIG. 4, the object which emerges form the football-shaped container is a football player. But in the embodiment shown in FIG. 5, when the two halves 16*a* and 16*b* of the football-shaped container are separated, then emerging from this container is a much larger football 18.

Football 18 is molded of open-cell, low-density flexible foam polyurethane material, and when compressed into a shrunken state it can then be stuffed into the football shaped container.

Fifth Embodiment

Figure 5:
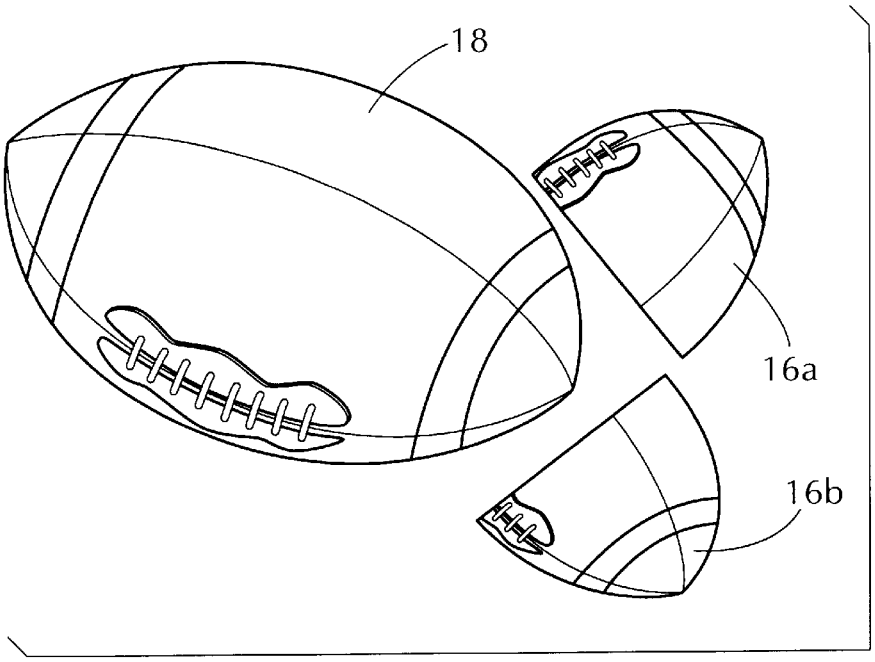
FIG. 5 shows a package in which the container resembles a small football and the object emerging therefrom resembles a much larger football.
Figure 6:
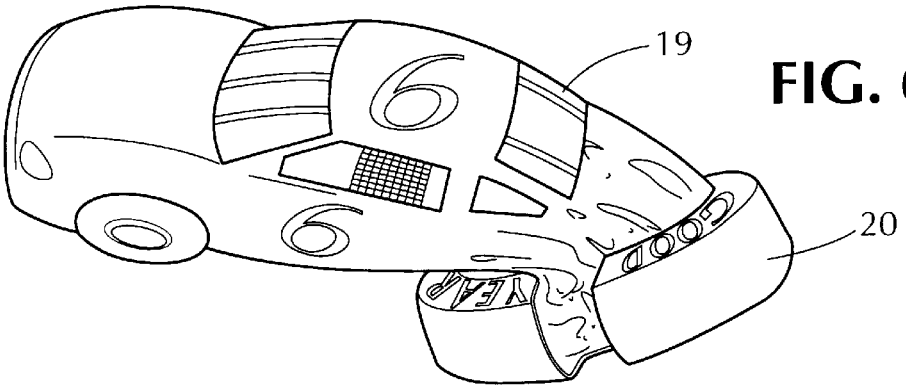
FIG. 6 illustrates a package in which the object resembles an automobile and the container therefor an automobile tire.

In the embodiment shown in FIG. 6, the object which in the shrunken state is stuffed into a small container is a miniature automobile 19 molded of the same flexible foam plastic material as the football 18 shown in FIG. 5.

The container 20 in this instance resembles an automobile tire and is therefore thematically related to the automobile. The object, instead of having the form of an automobile may have the form of a bus or trailer truck.

Sound-Producing Unit

All of the embodiments shown in FIGS. 1 to 6 are silent in the sense that when the figure or object is withdrawn from its small container and inhales air to recover its normal size and shape, no sound accompanies this activity.

Yet a dinosaur is capable of making loud sounds whose nature can only be imagined, for dinosaurs no longer exist. And if there are in fact aliens from outer space, one can assume that these aliens can produce audible sounds in order to communicate.

Figure 7:
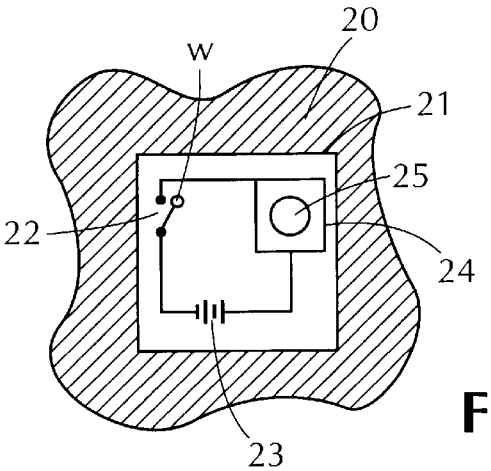
FIG. 7 shows a sound-producing unit embedded in the object.

In order therefore to provide compressible figures or objects in accordance with the invention capable of producing audible sounds that are appropriate to their nature, embedded in the compressible material 20 from which the figures or objects are formed is a self-sufficient miniature sound producing unit 21, as shown in FIG. 7.

Unit 21 includes an impact-sensitive switch 22 which when closed acts to connect a battery 23 to an integrated-circuit chip 24. In chip 24, the sounds to be produced by the object or figure are digitally stored in a ROM or other solid state memory device.

When switch 22 closes to activate chip 24, the sounds digitally stored therein are down-loaded and converted into analog signals. These signals are amplified and reproduced in a miniature loud speaker 25.

Impact switch 22 includes a flexible metal strip having a weight W at its free end which renders the switch sensitive to acceleration forces. When the flexible strip which acts as a movable contact flexes, it then engages a fixed contact to close the switch.

Hence when the object or figure having unit 21 embedded therein 21 pulled out of the container and the figure or object then inhales air to expand, the resultant agitation of the figure or object closes switch 22 to actuate the sound unit to cause it to generate the audible sounds stored therein. The same sounds can be generated when the figure is encased in its container to form a package. By shaking the package, the sounds will then be generated.

The audible sounds that are recorded in the unit are appropriate to the object in which it is embedded. Thus in the case of an automobile, the sounds produced can be those of a starting engine, while in the case of a dinosaur, these sounds can be like those of a roaring animal. But in the case of a football player, the sounds can be those of a football player's voice. Or the figure can be that of a lion, and the container therefor in the form of a lion's circus cage having an access door and the sounds these of a roaring lion.

Thus the container may be made to resemble Aladdin's Lamp and the figure entrapped therein can be a jinn or genie. In the case of Aladdin's Lamp, the sound chip may store the voice of the genie who when the package is shaken cries "Let me out and I will grant you three wishes!"

While there has been shown and described preferred embodiments of a package containing a shrunken figure in accordance with the invention, it will be appreciated that many changes and modifications may be made therein without, however, departing from the essential spirit thereof.

I claim:

1. A package housing an object in a shrunken state, said package comprising:

A. a shaped object resembling a humanoid or animal-like figure molded of a porous, compressible material;

B. an openable container having a form thematically related to the shaped object and an internal cavity therein for accommodating the object when the compressible material is compressed to expel air therefrom to assume a shrunken state, whereby when the container is opened to release the shrunken object, the compressible material then inhales air to recover its normal size and shape; and C. a sound-producing unit embedded in the object to generate audible sounds appropriate to the object, said unit including switching unit adapted to turn on the unit only when the unit is agitated.

2. A package as set forth in claim 1, in which the figure is molded of open-cell, flexible foam-plastic material.

3. A package as set forth in claim 2, in which the material is polyurethane.

4. A package as set forth in claim 3, in which the material is a low density polyurethene.

5. A package as set forth in claim 1, in which the object resembles a that of a dinosaur, and the container has the form of a dinosaur egg.

6. A package as set forth in claim 5, in which the egg is formed of a crackable plastic shell.

7. A package as set fort in claim 1, in which the object is the figure of an extraterrestrial alien, and the container has the form of a space ship.

8. A package as set forth in claim 7, in which the space ship has a hinged lid to provide access to an internal cavity into which the figure of the alien is stuffed.

9. A package as set forth in claim 1, in which the object resembles an automobile and the container resembles an automobile tire.

* * * * *